United States Patent [19]

Brough et al.

[11] Patent Number: 4,549,361

[45] Date of Patent: Oct. 29, 1985

[54] YARN HEATER

[75] Inventors: Denys W. Brough; Christopher J. Lawrence, both of Macclesfield, England

[73] Assignee: Rieter-Scragg Limited, Cheshire, England

[21] Appl. No.: 556,326

[22] Filed: Nov. 30, 1983

[30] Foreign Application Priority Data

Dec. 10, 1982 [GB] United Kingdom ..... 8235326
Mar. 19, 1983 [GB] United Kingdom ..... 8307666

[51] Int. Cl.[4] ..... F26B 7/00; F26B 20/00

[52] U.S. Cl. ..... 34/17; 34/23; 34/68; 34/155

[58] Field of Search ..... 34/23, 155, 68, 41, 34/17; 28/240, 241, 179; 432/8, 59

[56] References Cited

U.S. PATENT DOCUMENTS

| | | | |
|---|---|---|---|
| 3,303,548 | 2/1967 | Hills et al. | 34/155 |
| 3,606,655 | 9/1971 | Oberlander et al. | 34/155 |
| 3,633,256 | 1/1972 | Mallonee | 34/155 |
| 3,720,079 | 3/1973 | Katsumata et al. | 34/155 |
| 3,883,718 | 5/1975 | Ferment et al. | 34/155 |

FOREIGN PATENT DOCUMENTS

| | | |
|---|---|---|
| 689175 | 3/1953 | United Kingdom . |
| 850080 | 9/1960 | United Kingdom . |
| 923650 | 4/1963 | United Kingdom . |
| 1255957 | 12/1971 | United Kingdom . |
| 1281634 | 7/1972 | United Kingdom . |

*Primary Examiner*—Larry I. Schwartz
*Attorney, Agent, or Firm*—Oblon, Fisher, Spivak, McClelland & Maier

[57] ABSTRACT

A stabilizing or secondary heater, for producing a crimped set yarn, comprises a tube having two substantially parallel bores extending therealong, one bore providing a yarn path for the yarn. Air is passed along the other bore, in a direction opposed to the direction of travel of the yarn, so as to be heated, and then through a communicating inlet and passages to impinge upon and be entrained by yarn, the air travelling along the yarn path bore to prevent entrainment of cold ambient air therealong and to ensure good heat transfer to the yarn.

11 Claims, 2 Drawing Figures

YARN HEATER

Figure 1:
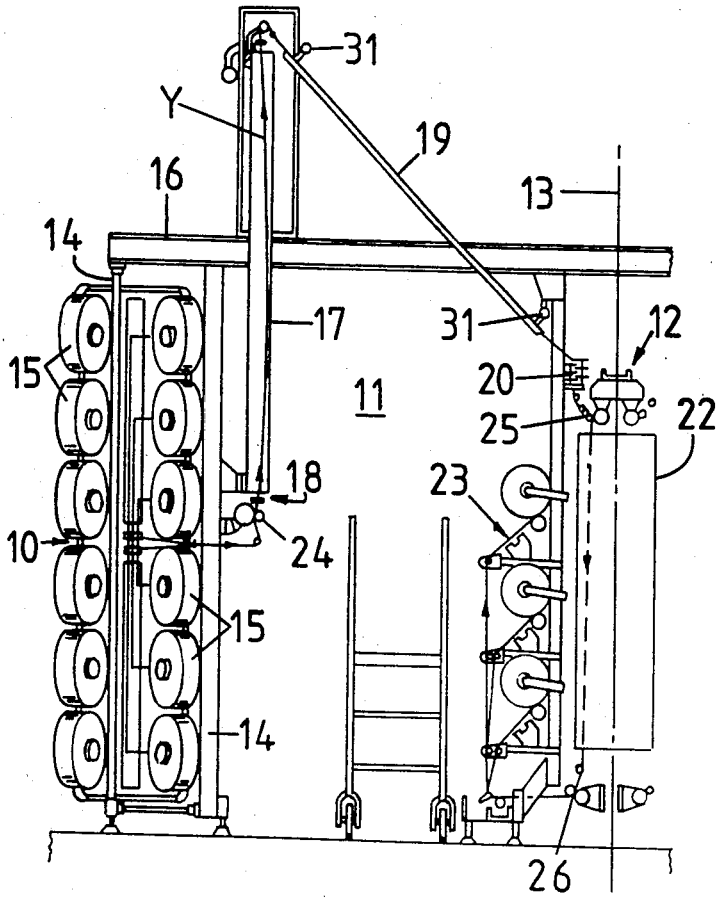

This invention relates to the heating of yarn and to heaters for such use, and in particular to the heating of yarn and yarn heaters such as are used in textile machinery, for example yarn texturising machines. Such machines employ heaters for the purpose of heating the yarn to its softened state whilst a crimping operation is performed thereon, for example a false twist may be applied thereto, and also for the heating of yarn to soften it in order to perform a crimp modifying operation on the yarn, such as may be provided subsequent to a false twist crimping operation.

In a multi-station yarn texturing machine which textures yarn by false twist crimping, a yarn is taken from a supply, over a heater, through a cooling zone to a false twist device. Twist runs upstream of the false twist device to the heating zone whilst the cooling zone causes the yarn to set by allowing it to return to a lower temperature. Such a process produces a torque-stretch yarn which may then be wound up on a package. Depending upon the state of the supply yarn it may be drawn prior to the false twisting step (sequential draw-texturing) or during the false twisting step (simultaneous draw-texturing). If a set yarn is required instead of a torque-stretch yarn, a second or stabilizing heater is provided between the false twist device and the package wind-up, the yarn being fed through this second heating zone under controlled overfeed conditions. In this case the final product is a crimped yarn of low stretch or extensibility and bulk level. The temperature of the heater and the length of time taken by the yarn in passing through the heating zone must be such as to provide that the yarn reaches a temperature sufficient to cause the desired setting and the desired reduction of bulk level of the yarn.

From the production and cost points of view, it is desirable to have as high a yarn throughput speed as possible through the machine. This has meant that as throughput speeds have increased the lengths of the heaters and cooling zones needed in the machines have had to be increased in order that the yarn can have attained the desired temperatures as it passes through these zones.

Since there are disadvantages associated with having the yarns negotiate tortuous paths through the machine, it has resulted in texturing machines of this type becoming larger and therefore more difficult to use. Walkways at upper levels of the machines may be provided, or alternatively step-trolleys, in order that an operator can gain access to the higher parts of the machine.

It is an object of the present invention to provide a yarn heater in which the heating efficiency is increased, thus allowing use of a shorter heater than was the case heretofore, or a higher yarn throughput speed for the same heater length.

It is also an object of the present invention to produce a set yarn in as efficient a manner as possible. According to one aspect of the invention there is provided a yarn heater having means defining a heated yarn path for a yarn to travel in contact therewith between an inlet and an outlet thereof and means providing a supply of heated fluid to impinge upon a yarn travelling along said yarn path in the region of said inlet. Preferably the fluid supply providing means is operable to restrict entrainment of ambient air along said yarn path and means may be provided to direct said heated fluid to travel along said yarn path from said inlet to said outlet in contact with a yarn travelling therealong.

Said yarn path may be curved, whereby tension in said yarn ensures such contact therewith. The heater preferably comprises a tube having a bore through which the yarn may pass. The tube may be curved along its length, in which case the tension in the yarn will cause it to travel in contact with the inner surface of the tube. Also, the stream of heated fluid is caused to travel through the bore of the tube. Preferably the fluid is air.

The air may be assisted in such travel by being supplied at above ambient pressure at the inlet of the tube and/or by suction applied at the outlet of the tube.

In travelling through the tube, the air helps to forward the yarn, thus increasing the yarn overfeed capability and so providing improved processing flexibility.

Preferably means are provided for controlling the rate of flow of air along the tube. Such control means may comprise an adjustable nozzle device located at the inlet of the tube.

Preferably the fluid is heated by the heater, in which case the fluid may be caused to pass along the heater in a direction substantially parallel with, and spaced from, the yarn path, but in the opposite direction to that travelled by the yarn along the yarn path. In this case the heater may have two substantially parallel bores extending therealong, and a communicating inlet between said bores adjacent one end thereof, said one end of one of said bores forming an inlet for the yarn to that one bore which provides the yarn path. The heater may comprise an electric heating element. Alternatively the heater may comprise top and bottom header tanks between which said yarn path defining means extend and containing or through which a heating medium, i.e. a second heated fluid, is circulated.

According to another aspect of the invention there is provided a method of producing a crimped set yarn comprising passing a crimped yarn through a heating zone between an inlet and an outlet thereof along a predetermined heated yarn path in contact with a heater defining said yarn path and providing a supply of heated fluid to impinge upon said yarn in the region of said inlet. Preferably entrainment of ambient air along said yarn path is restricted and said heated fluid may be caused to pass along said yarn path in contact with said yarn.

Preferably the crimped yarn is overfed through said heating zone. By means of the invention a set yarn is produced, the bulk level of the yarn being reduced in the heating zone.

Figure 2:
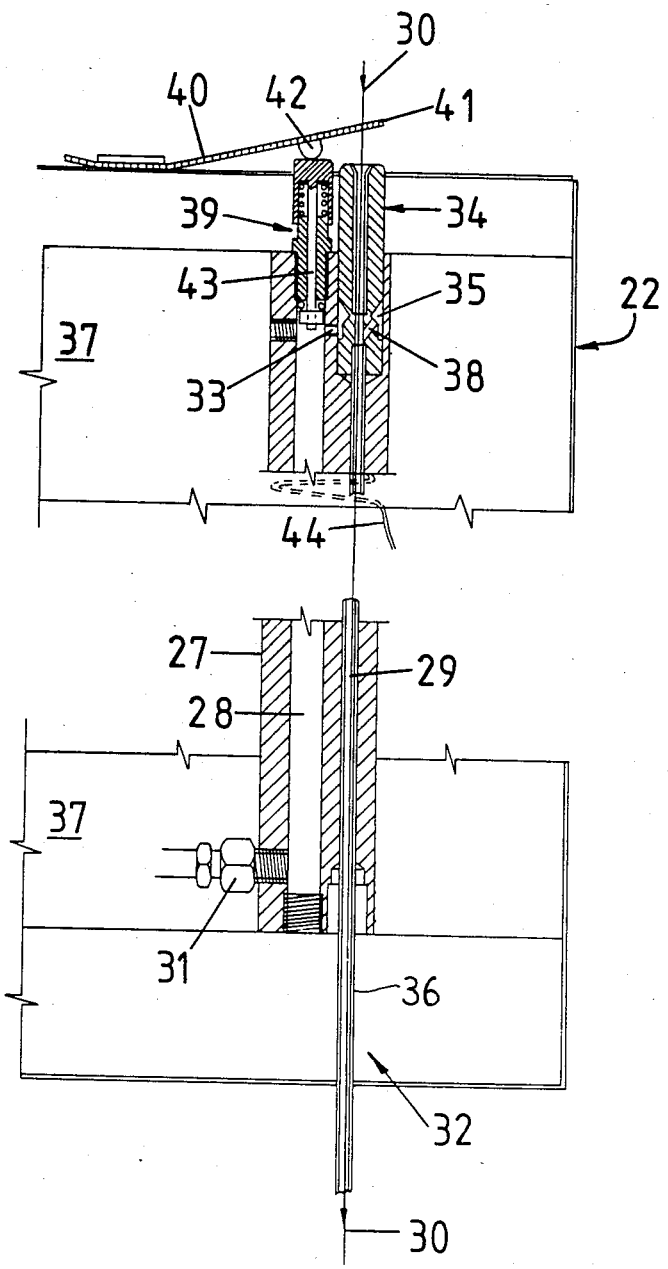

One embodiment of yarn heater in accordance with the invention will now be described with reference to the accompanying drawing in which:

FIG. 1 is a diagrammatic end view of a typical double heater yarn texturing machine and FIG. 2 is a longitudinal sectional view of a heater of the machine of FIG. 1.

Referring to FIG. 1 of the drawing, the yarn texturing machine comprises a stand-off creel section 10 spaced by an operator's aisle 11 from a texturing section 12. Only the left-hand half of the full machine is shown, since on the right of the longitudinal centre line 13 the right-hand half is a mirror image of the left hand half.

The machine is a multi-station machine, although in the end view only one threadline can be indicated. A creel frame 14 carries yarn supply packages 15 in columns and tiers. The columns are six high, the creel height being about 2.8 meters to cross-struts 16 which link it with the texturing section 12. The packages 15 need not be mounted on the fixed main frame, but instead could be on movable sub-frames (not shown) each carrying a predetermined number of packages.

The primary heaters 17, only one of which is shown in the drawing, are disposed upright in proximity with the creel and preferably (as shown) at that side of the creel 10 which faces the texturing section 12 across the aisle 11, the heaters 17 being mounted on the creel frame 14. The inlet end 18 of the heater 17 is well above floor level and approximately midway of the creel height, and the heater shown is 2 meters in length and extends above the creel. From the top exit end of the heater 17, the yarn Y runs over an elongate stabilising and cooling guide 19 which spans the aisle 11 and is steeply inclined downwards towards the texturing section 12, the length of this guide 19 being about 2.2 meters, depending upon the length of the heater 17, which could also be 2.5 or 3 meters or more in length, without any need for drastic modification of the machine.

From the guide 19 the yarn enters a false twister 20 of the texturing section 12, the false twister preferably comprising stacks of overlapping friction discs, as described in our British patent specification Nos. 1,419,085 and 1,419,086. From the false twister the yarn runs through a secondary heater 22 and then to a package winder section 23.

At the inlet end 18 of the primary heater 17 are the usual input feed rolls 24, and between the false twister 20 and the secondary heater 22 are the usual intermediate feed rolls 25, the usual delivery rolls 26 being located between the secondary heater 22 and the package winder section 23. The secondary heater 22 could be omitted to provide a single heater machine.

Referring now to FIG. 2 there is shown in longitudinal section the stabilizing or second heater 22 of the machine of FIG. 1, although a heater of the type hereinafter described could be used other than as a stabilizing heater, or on any other type of textile machine, if desired.

The heater 22 comprises a tube 27 having two bores 28,29 extending along its length. Bore 29 provides the path for a yarn 30 through the heater 22. If the bore 29 is curved, the tension in the yarn 30 would ensure contact between itself and the wall of bore 29 so that efficient transfer of heat therebetween can occur. However, a straight tube 27 is preferred and has been found to provide satisfactory heat transfer to the yarn 30.

Bore 28 provides an air pre-heating gallery and is provided with an inlet 31 for air at above ambient pressure, for example at 10 psi gauge (7031 $Kg/m^2$).

Adjustment of the pressure of the air supply provides one form of control of the quantity of air flowing through the heater 22. The air travels from the air inlet 31, which is located adjacent the yarn outlet end 32 of the heater 22, along bore 28 in a direction opposite to that travelled by the yarn 30. A communicating inlet 33 is provided between air heating gallery 28 and yarn path bore 29, the air having been heated to substantially the same temperature as the heater 22 when it reaches inlet 33. The communicating inlet 33 is located at the yarn inlet end of bore 29, at which there is provided an air injector nozzle 34. The nozzle 34, through which the yarn 30 passes into bore 29, has an annular recess 35 and passages 38 which communicate with bore 29 to allow the flow of air into bore 29. Alternatively an adjustable nozzle 34 may be provided if it is desired to adjust the flow rate of air into bore 29.

A length of liner tube 36 extends from the yarn outlet end 32 of the heater 22 and is connected to a suction threading adaptor thereby providing further control of the air flow through the bore 29. The heated air passing through the communicating inlet 33 and passages 38 is entrained by the travelling yarn 30 and contributes to the heating of the yarn 30. In addition there is a tendency for some heated air to pass out of the yarn inlet end of the nozzle 34 or at least to provide a pressure in such region. By this means there is restricted, or even prevented, the entrainment of relatively cold ambient air into the bore 29. This has the effect of increasing the heat transfer efficiency of the heater and also eliminates or reduces the condensation of spin finish from the yarn 30 onto the bore 29 of heater 22.

In consequence the heating efficiency of the heater 22 is greater than is the case with heaters used heretofore, and therefore the length of heater 22 can be less than such known heaters. This characteristic enables a machine incorporating such a heater 22 to be smaller than would otherwise be the case, which is of considerable advantage from the ergonomic point of view. In addition, the entrainment of the heated air along the yarn path facilitates the removal of fumes which are generally generated in the heating zone.

Heating efficiency may also be enhanced by virtue of the fact that the heated air issuing from the communicating passages 38 creates a vortex or turbulent flow region at the inlet to bore 29, thus ensuring good and rapid heat transfer from the air to the yarn 30.

The heater 22 is heated by means of electrical heating elements 44 which are in good thermal contact with the aluminium alloy heat transmission plates 37 to which the inlet and outlet ends of the tube 27 are secured. Alternative forms of heating means may be provided if desired. For example, plates 37 could be incorporated in top and bottom header tanks through which a heated fluid is circulated.

To facilitate threading of heater 22, a valve 39 is provided. A spring steel lever 40 is secured to the body of heater 22 and has a hook shaped free end 41 over which the yarn end 30 may be passed. Lever 40 has a protrusion 42 on the rear face thereof which is in contact with the plunger 43 of valve 39. To thread the yarn end 30 into bore 29, suction is applied to the extended liner tube 36 and lever 40 is depressed. Movement of lever 40 serves to bring the yarn end 30, which passes over the hooked end 41, close to the inlet of nozzle 34, and also moves the plunger 43 of valve 39 to seal the communicating inlet 33. In consequence, the flow of pressure air from bore 28 is stopped whilst the effect of suction applied at extended liner tube 36 draws the yarn 30 into bore 29. Lever 40 is then released to restore the flow of heated pressure air from bore 28 to bore 29.

Due to the passage of heated fluid along the yarn path, the heating efficiency of the heater is improved in comparison with such a heater when used without the heated fluid. In consequence, for the same reduction of bulk level of the yarn in passing through the heating zone, the temperature of the heater when the heated fluid is passed thereover can be considerably less than is required whne no heated fluid is used.

For example, when using 167 decitex yarn running at 600 meters/min and with 1 cu ft/min (28.3 liters/min) of air at a pressure of between 1 and 4 p.s.i. (0.07 and 0.28

Kg/sq cm) being passed along the yarn path in the heating zone, the heater may be approximately 35° lower temperature than would be required with the same heater without the air flow to achieve the same reduction in bulk level. Conversely for the same heater temperature, the bulk level can be reduced by about 12% when the abovementioned air flow is used from that achieved when no airflow is used. The amount of overfeed of the yarn is the same in both cases since it has been found that, provided that there is adequate overfeed through the heating zone, the bulk level reduction is not affected by the amount of overfeed. The abovementioned air flow rate and pressure range have been found suitable for a range of yarn throughput speeds.

Another advantage of the method of the present invention is that due to the greater efficiency of the heater when the air flow is provided, and the improved heat transfer to the yarn, the variation of bulk level along the yarn is substantially reduced in comparison with that obtained when no airflow is provided.

What we claim is:

1. In a multi-station yarn texturing machine having a yarn heater comprising a heat transmission plate; heating means operable to heat said plate; and, for each yarn, means defining a heated yarn path; each of said yarn path defining means comprising a tube having an inlet end an outlet end, being mounted in good thermal contact with said plate, and having two substantially parallel bores extending therethrough, and a communicating inlet extending between said bores adjacent said inlet end; a method of heating a yarn comprising passing a yarn through one of said bores in contact with said tube over at least a portion of said one of said bores which is sufficiently long so that efficient transfer of heat between said tube and the yarn can occur; passing a fluid along the other of said bores in a direction from said outlet end to said inlet end, thereby heating said fluid therein; and passing said heated fluid through said communicating inlet to impinge upon said yarn as it travels along said yarn path.

2. A method according to claim 1 comprising passing said heated fluid along said yarn path in contact with said yarn.

3. A method according to claim 1 wherein said yarn is crimped and is overfed through said heater to produce a crimped set yarn.

4. A method according to claim 1 comprising restricting the flow of heated fluid to said yarn path during threading of a yarn through said heater.

5. A method according to claim 1 comprising restricting entrainment of ambient air along said yarn path.

6. In a multi-station yarn texturing machine, a yarn heater comprising a heat transmission plate; heating means opeable to heat said plate; and, for each yarn, means defining a heated yarn path, each of said yarn path defining means comprising a tube having an inlet and an outlet end, being mounted in good thermal contact with said plate, and having two substantially parallel bores extending therethrough, one of said bores providing said yarn path along which, in use, a yarn passes in contact with said tube over at least a portion of said one of said bores which is sufficiently long so that efficient transfer of heat between said tube and the yarn occurs; means providing a supply of fluid to pass along the other of said bores in a direction from said outlet end to said inlet end to be heated therein; and a communicating inlet extending between said bores adjacent said inlet end through which said heated fluid passes to impinge upon a yarn traveling along said yarn path in contact with said tube.

7. A yarn heater according to claim 6 having means operable to control the rate of flow of heated fluid along said yarn path.

8. A yarn heater according to claim 6 wherein said fluid providing means is operable to supply air at a pressure above ambient pressure.

9. A yarn heater according to claim 6 having valve means operable to restrict the flow of heated fluid to said yarn path during threading of a yarn in said heater.

10. A yarn heater according to claim 6 wherein said fluid providing means comprises air suction means in fluid flow connection with said outlet.

11. A yarn heater for a multi-station yarn texturing machine, said yarn heater comprising:

(a) an elongated body having two parallel bores therein, (i) one of said bores having an inlet at a first end of said tube and an outlet at the second end of said tube and being adapted to receive yarn which, during use of the yarn heater, enters said one of said bores at the inlet of said one of said bores and exits said one of said bores at the outlet of said one of said bores, said one of said bores being curved, and (ii) the other of said bores having an inlet for fluid at the second end of said tube and an outlet for fluid at the first end of said tube which communicates with said one of said bores adjacent its inlet;

(b) first means for introducing pressurized fluid into said inlet for fluid; and (c) second means for heating said elongated body, whereby, during use of the yarn heater, (d) the tension in the yarn ensures good thermal contact between the yarn and the wall of said one of said bores, whereby the heat of said elongated body is transferred directly to the yarn, and (e) fluid is heated as it passes through said other of said bores, and the fluid so heated passes through said oulet for fluid at the first end of said tube and into said one of said bores, where the fluid further heats the yarn as it passes through said one of said bores and, additionally, militates against the entrance of ambient air into said one of said bores.

* * * * *